US006924426B2

(12) United States Patent
Clynes

(10) Patent No.: US 6,924,426 B2
(45) Date of Patent: Aug. 2, 2005

(54) AUTOMATIC EXPRESSIVE INTONATION TUNING SYSTEM

(75) Inventor: Manfred Clynes, Sonoma, CA (US)

(73) Assignee: Microsound International Ltd., Sonoma, CA (US)

( * ) Notice: Subject to any disclaimer, the term of this patent is extended or adjusted under 35 U.S.C. 154(b) by 259 days.

(21) Appl. No.: 10/259,863

(22) Filed: Sep. 30, 2002

(65) Prior Publication Data

US 2004/0060423 A1 Apr. 1, 2004

(51) Int. Cl.[7] ..... G04B 13/00; G10H 7/00

(52) U.S. Cl. ..... 84/609; 84/611; 84/649; 84/651; 84/454; 84/DIG. 18

(58) Field of Search ..... 84/600, 609–611, 84/649–651, 454–455, DIG. 18

(56) References Cited

U.S. PATENT DOCUMENTS 4,152,964 A * 5/1979 Waage ..... 84/675
4,248,119 A * 2/1981 Yamada ..... 84/637
4,523,506 A * 6/1985 Hollimon ..... 84/454
5,501,130 A 3/1996 Gannon et al.
5,973,252 A * 10/1999 Hildebrand ..... 84/603
6,093,879 A * 7/2000 Pye ..... 84/451
6,407,326 B1 6/2002 Kondo ..... 84/615
6,501,011 B2 * 12/2002 Wesley ..... 84/719

* cited by examiner

*Primary Examiner*—Marlon Fletcher
(74) *Attorney, Agent, or Firm*—Fish & Richardson P.C.

(57) ABSTRACT

A method for the algorithmic expressive intonation tuning (EIT) and performance of electronic, computer and MIDI musical works relies on melodic intervals, rather than on chordal harmony, and acts by desirably modifying the pitch of a note slightly (compared to equal temperament tuning), depending on the next melodic note. This dynamic, non static, melodic tuning emulates, and can even possibly augment, aspects of outstanding live human musical performance achieved with regard to pitch subtleties, as it enhances the living sounding, real aspects of the performance of electronic, computer and MIDI music, by sensibly causing a slightly different pitch of particular notes, depending on the size of an interval and on whether an interval is ascending or descending, with the same note subtly having more than one pitch often, depending on melodic context. This method of tuning affecting the notes has a further advantage of not requiring transposition, regardless of how much the music modulates, since it uses melodic intervals. It can treat entire symphonies of more than 100 voices simultaneously as easily as solo works.

20 Claims, 3 Drawing Sheets

Step means the same as "interval"

AUTOMATIC EXPRESSIVE INTONATION TUNING SYSTEM

TECHNICAL FIELD

This invention relates to electronic and computer synthesized music systems, and, in particular, to the tuning and pitch adjustments of the individual notes of such music systems.

BACKGROUND

Present day electronic and computer synthesized music systems employ equal temperament as the prevalent built-in tuning system. However, it is well known to good musicians playing string and other instruments where pitch can be controlled, as well as to those using the human voice, that, for proper music realization and expressiveness, equal temperament is an insufficient compromise. Gannon U.S. Pat. No. 5,501,130 provides an exhaustive historical treatment of different static tuning systems and antecedents.

Static tuning systems other than equal temperament, in which a note always has the same pitch (except if the tuning is transposed), are cumbersome to use in the music, e.g., of the last three hundred years requiring transposition. As a result, such static tuning systems are little used electronically, and, moreover, importantly, do not satisfy the requirements of expressive intonation. The relative inflexibilities of tuning a piano have largely been accepted by default for electronic and computer music as the path of least resistance. The subtleties of expressive intonation have not been realized systematically by electronic and computer means, thereby keeping such music historically continuingly impoverished.

SUMMARY

According to one aspect of the invention, a method for expressive intonation tuning of electronic, synthesizer and computer music comprises the steps of: considering a first note of a melodic interval, considering a second note of the melodic interval, the second note following the first note, and incrementally emending the nominal pitch of the first note and/or the second note depending on the nominal pitch of the second note, relative to that of the first note.

Preferred embodiments of this aspect of the invention may include one or more of the following additional features. The method for expressive intonation tuning comprises the further steps of: considering whether a melodic interval containing the first note and the second note is ascending or descending, and incrementally emending the nominal pitch of the first note or of the second note, depending on whether melodic interval is ascending or descending. The method for expressive intonation tuning comprises the further step of: assigning to each occurrence of a melodic interval a specifically sized increment of predetermined value, to increase or decrease that melodic interval. The method for expressive intonation tuning comprises the further step of assigning a specifically sized increment of predetermined value in a range of between about +10 cents and −10 cents, with resolution of 0.1 cent, to such an interval. The method for expressive intonation tuning comprises the further step of increasing or decreasing the pitch of a note in the melodic interval relative to the equal temperament system by up to 24 specific characteristic increments, each of the characteristic increments being assigned to one of 12 ascending and 12 descending intervals of a scale. The method for expressive intonation tuning comprises the further step of assigning the specific increments to the notes of the melodic interval according to a step series denoting the sequence of melodic steps, e.g. as a number of semitones, occurring in a particular voice of the musical work. The method for expressive intonation tuning comprises the further step of assigning to each voice of a musical work a step series and pitch increments. The method for expressive intonation tuning comprises the further step of combining each step with an index denoting subtract increment from the present note or add increment to the next note to provide 48 different assignment actions. The method for expressive intonation tuning comprises the further step of generating music incorporating the incremented pitch values. The method for expressive intonation tuning comprises the further step of scaling the increment according to duration of specific notes, with relatively faster notes receiving relatively larger increments. The method for expressive intonation tuning comprises the further step of applying the pitch increment gradually over the duration of a note, rising to a peak value and then falling towards the end of the note. The method for expressive intonation tuning comprises the further step of applying the increments of pitch following an adjustable curve. The method for expressive intonation tuning comprises the further step of selectively disabling expressive intonation tuning of one or more voices of the musical work. The method for expressive intonation tuning comprises the further step of providing preset default values for pitch increment values and index settings. The method for expressive intonation tuning comprises the further step of modifying the default values for requirements of a specific musical work or of one or more parts of a musical work. The method for expressive intonation tuning comprises the further step of modifying the default values for requirements of, e.g., ethnic music, jazz, blues, reggae, or other popular music. For improvisations, the method for expressive intonation tuning comprises the further step of, as the second note is played, comparing its nominal pitch with the nominal pitch of the first note stored in computer memory; calculating the step in semitones between the first note and the second note; and selecting the appropriate increment and applying it immediately to the nominal pitch of the second note. Preferably, the appropriate increment is applied to the nominal pitch of the second note within a few milliseconds of playing of the second note, e.g. before the key hits bottom.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
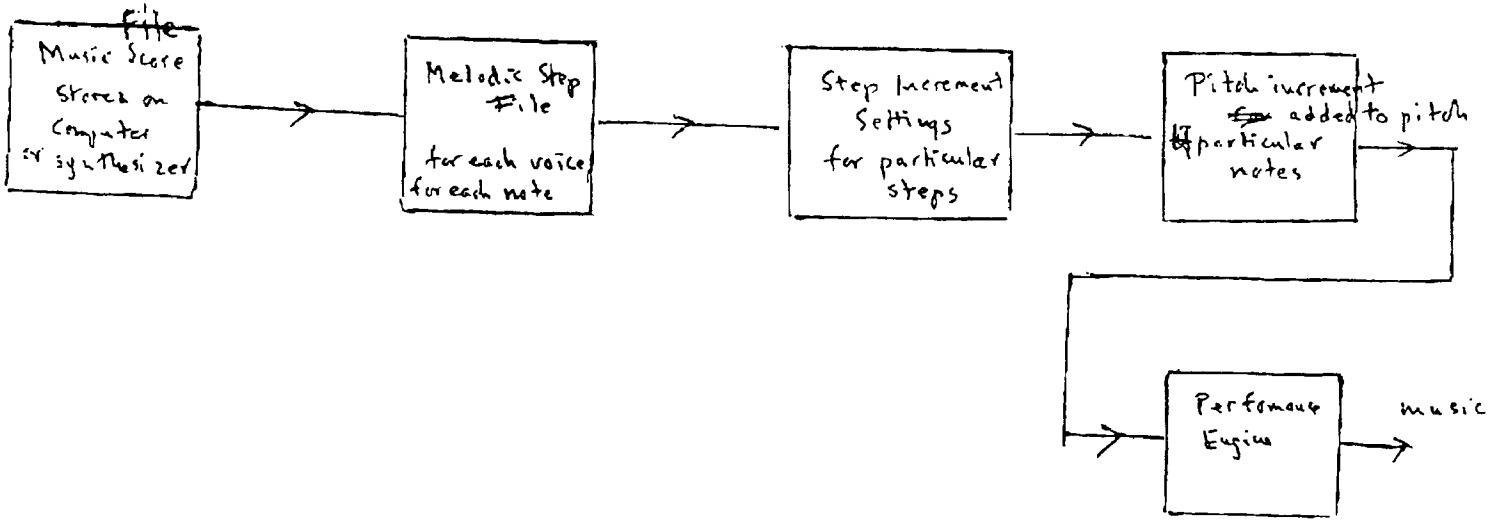
FIG. 1 is a diagrammatic representation of a system of tuning of the invention for providing expressive intonation to computer, electronic or MIDI music.

During fine musical performances, a note must be played or sung at slightly different pitches, depending on context, including whether the interval is ascending or descending in pitch. This melodic and dynamic[1] tuning is called "expressive intonation." The difference may be as little as only a few cents (where one cent equals one hundredth of a semitone), but the result is much more natural sounding music. A good musician or singer employs expressive intonation intuitively; however, little is known about its quantitative aspects. The present invention addresses the problem with an algorithm that permits calculation of the required small deviations from equal temperament, based on the sequential design of the notes in a melody to be performed. The effect is tuning by melodic intervals, rather than by isolated notes. For example, depending on the melody, and depending on whether the notes of the interval to be adjusted or tuned are ascending or descending, the first note or the second note of an interval may be adjusted to change its pitch slightly, typically by one or only a few cents. This adjustment process is performed systematically and differentially for all of the intervals within a particular voice, and for all voices, depending on the melodic intervals encountered. The result is a more natural sounding music.

[1]"Dynamic" means that the same note needs to have different pitches depending on the melodic context.

The secret of expressive intonation has been an element of the artistic expressive armory as a cherished, but little documented, tool. For example, typically, the leading note is sharpened when it leads to the tonic (B in the key of C major going to C), but the amount or degree of sharpening is generally left to the discretion of the musical performer. It is a very interesting ability of the human brain to be able to determine when the increase in pitch is of the correct amount, and, conversely, to detect when the adjustment is too much or too little. In fact, these expressive intonations, or small fluctuations of pitch, typically do not relate to harmonic overtones, or to pure mathematical ratios. Rather, they more often relate to the emotional meaning of the music. For example, the highest note of the melody of "The Marseillaise" benefits from being slightly sharp, helping to give the melody its appropriate enthusiasm.

Electronic and computer music has been unable to systematically incorporate this kind of dynamic tuning. For example, static tuning systems, such as Mean Tone, Well tempered, Just, Kimberger, Werckmeister, Pythagorean, and others, do not change the pitch of a note depending on its melodic context or depending on whether an interval is ascending or descending. Although such static tuning systems have been incorporated into electronic and computer music, and even have been transposed for various portions of musical pieces that modulate into more distant keys, these systems employ procedures much different from those of the present invention. Therefore, they do not, and cannot, provide musical performances with expressive intonation, in which the same note can have slightly different pitches depending on its melodic context, e.g., such as ascending and descending intervals. In fact, it is found that even a "neutral" musical sequence, such as a scale, benefits from being played with expressive intonation, with ascending and descending note intervals being performed with slightly different pitch.

Moreover, as will hereinafter be described, the present invention, being based on intervals, makes it possible to apply expressive intonation in all keys of the music, without having to transpose any aspects of the algorithm to fit specific portions of the pieces.

Figure 2:
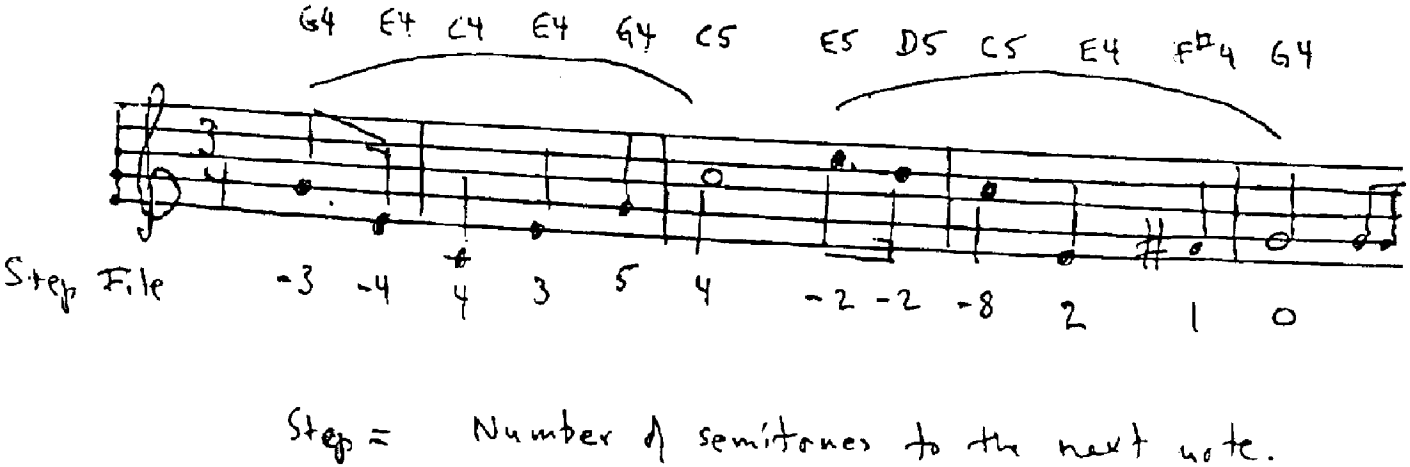
FIG. 2 is a diagrammatic representation of a musical interval marked with a step file for providing expressive intonation to the music when performed by computer, electronic or MIDI.
Figure 3:
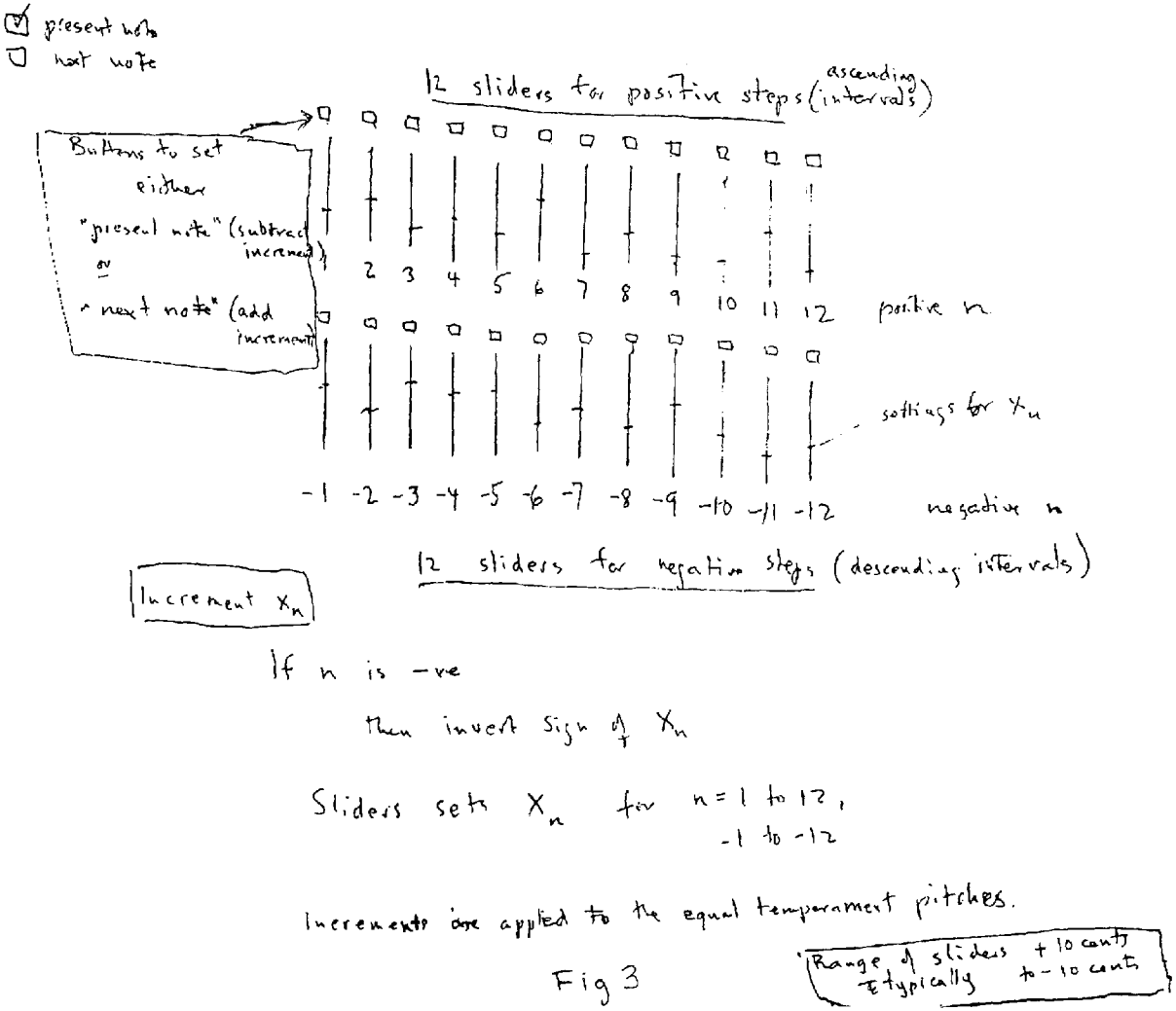
FIG. 3 is a diagrammatic representation of a control board for setting adjustments to notes of a musical interval for providing expressive intonation to computer, electronic or MIDI music.
Figure 1:
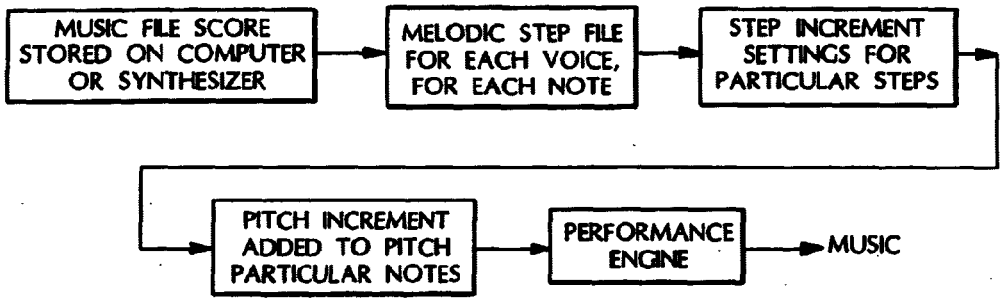
Figure 2:
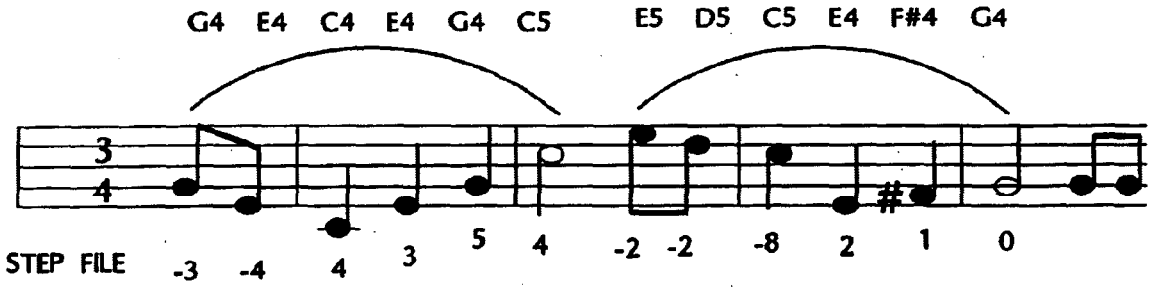
Figure 3:
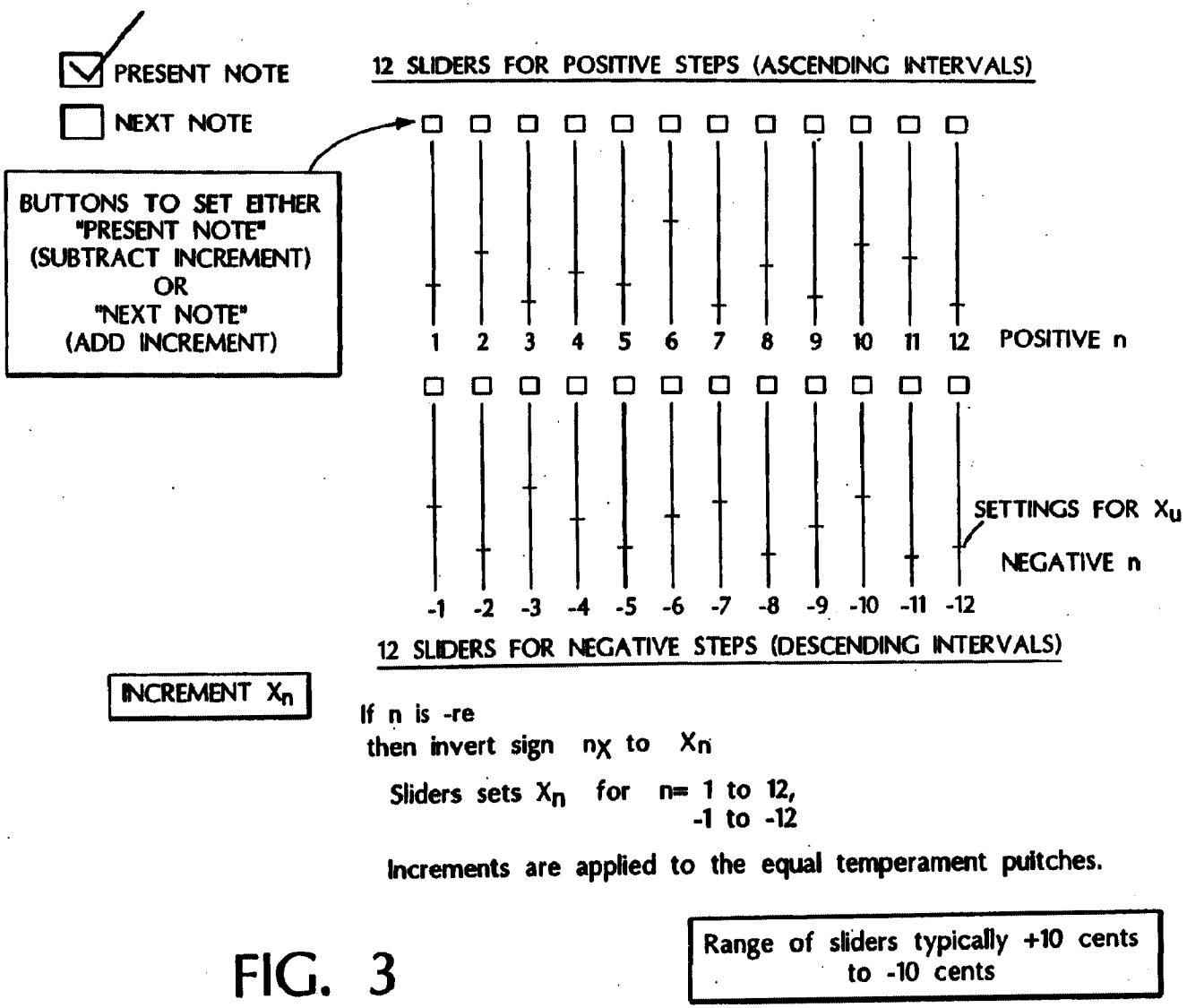
Figure 1:
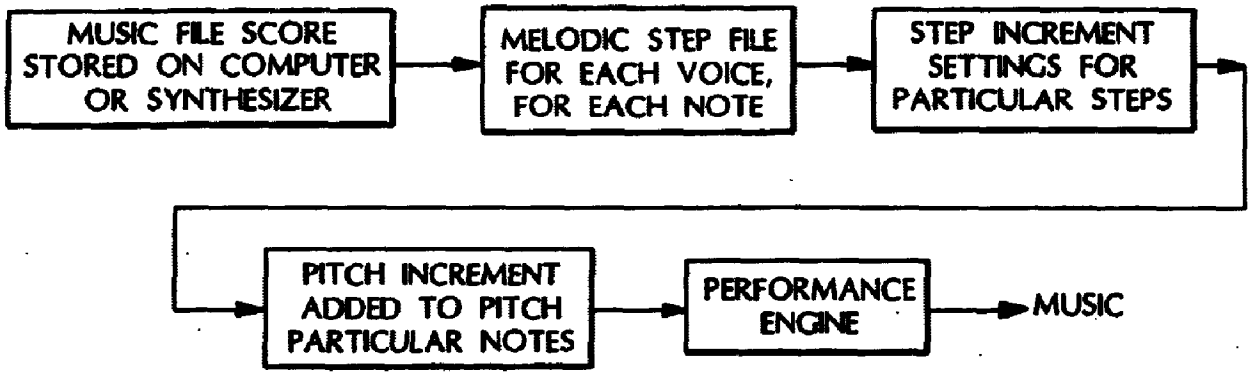
Figure 2:
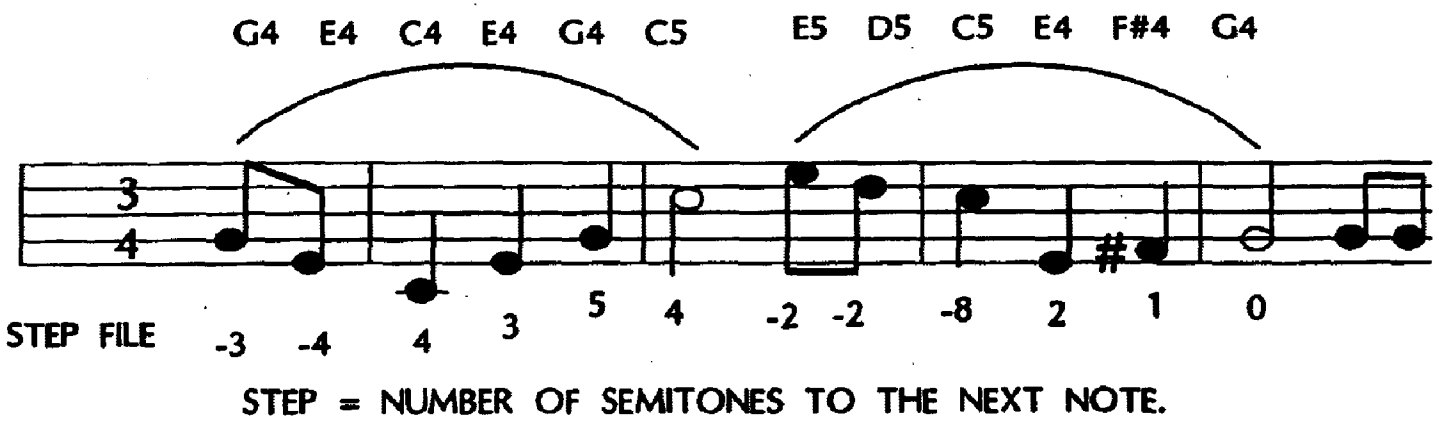
Figure 3:
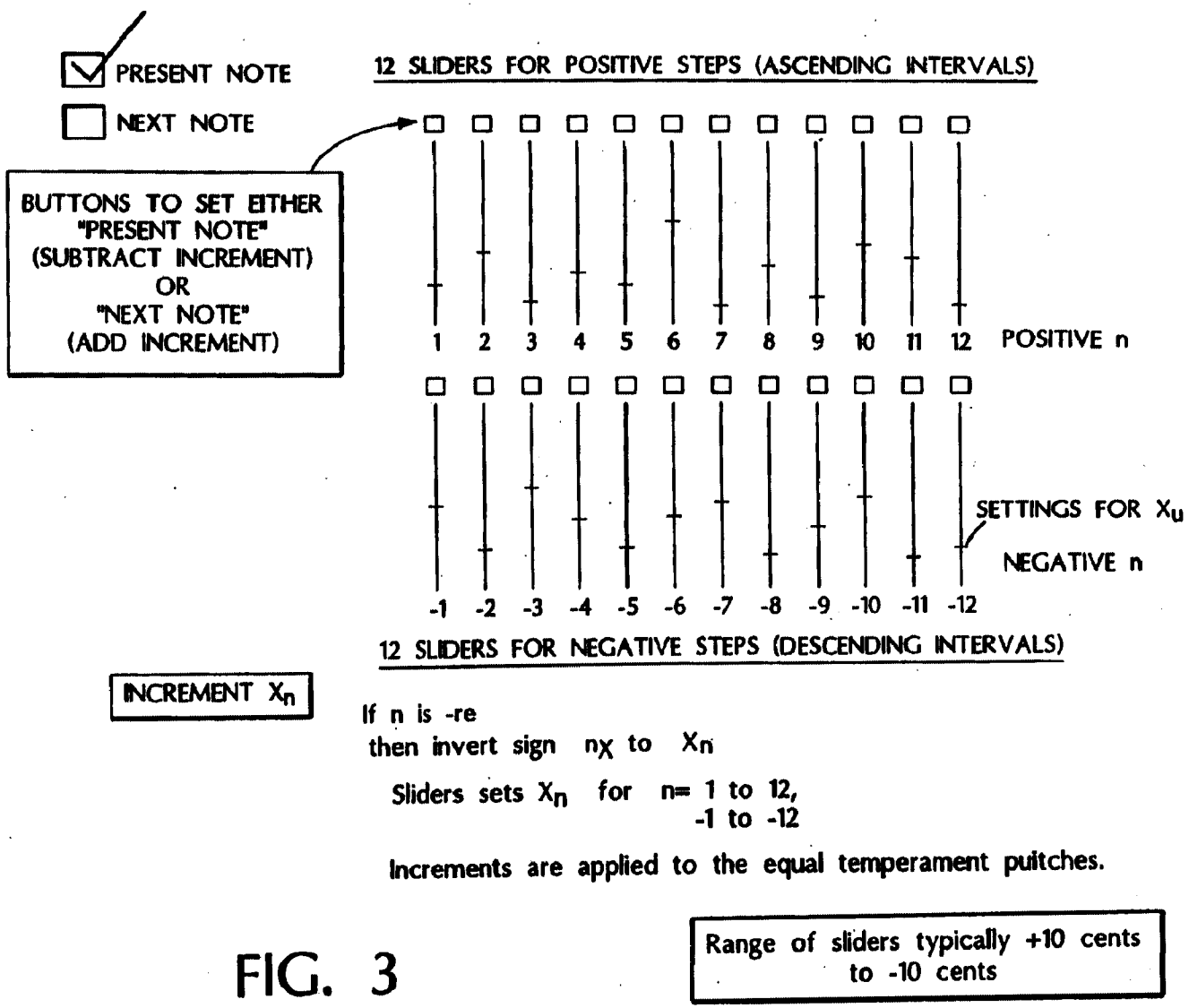
Figure 1:
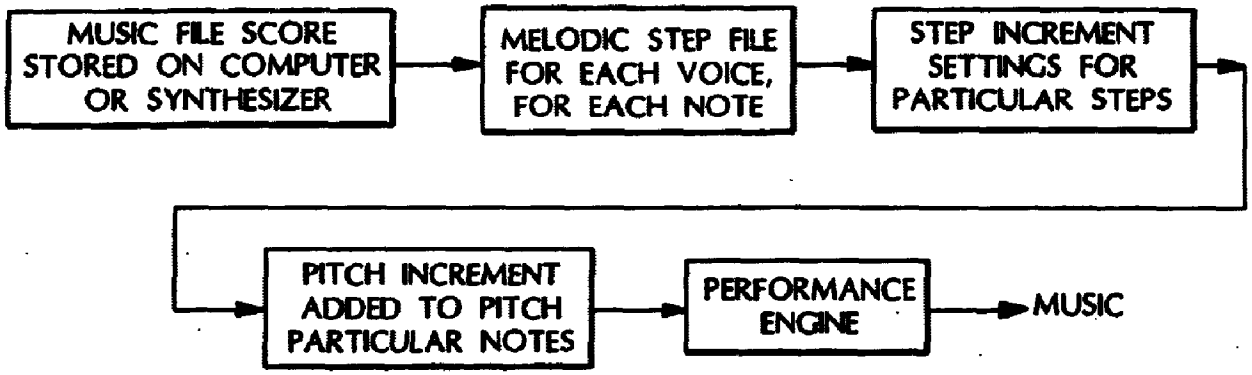
Figure 2:
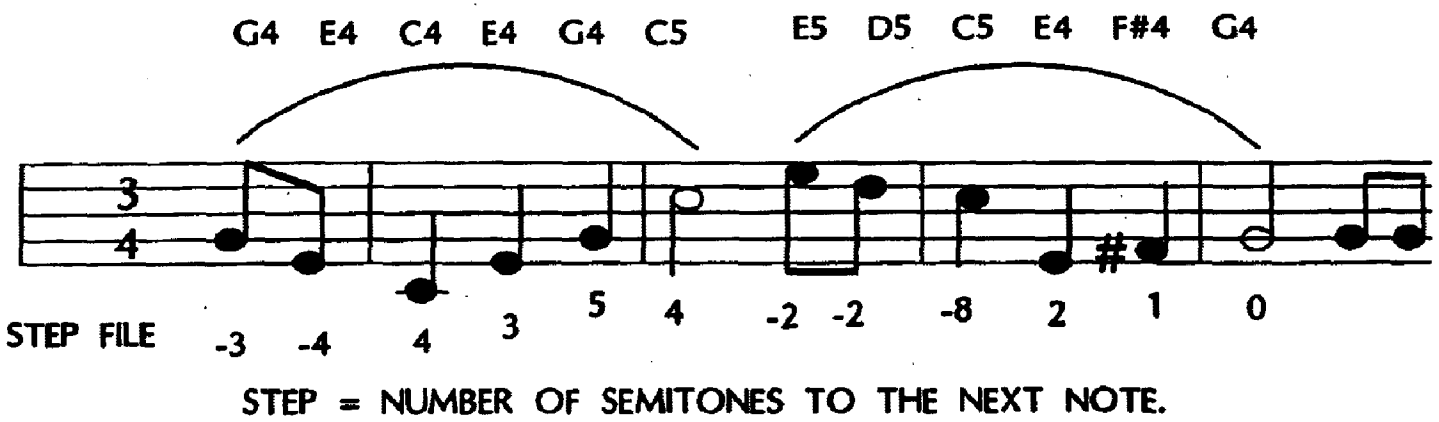
Figure 3:
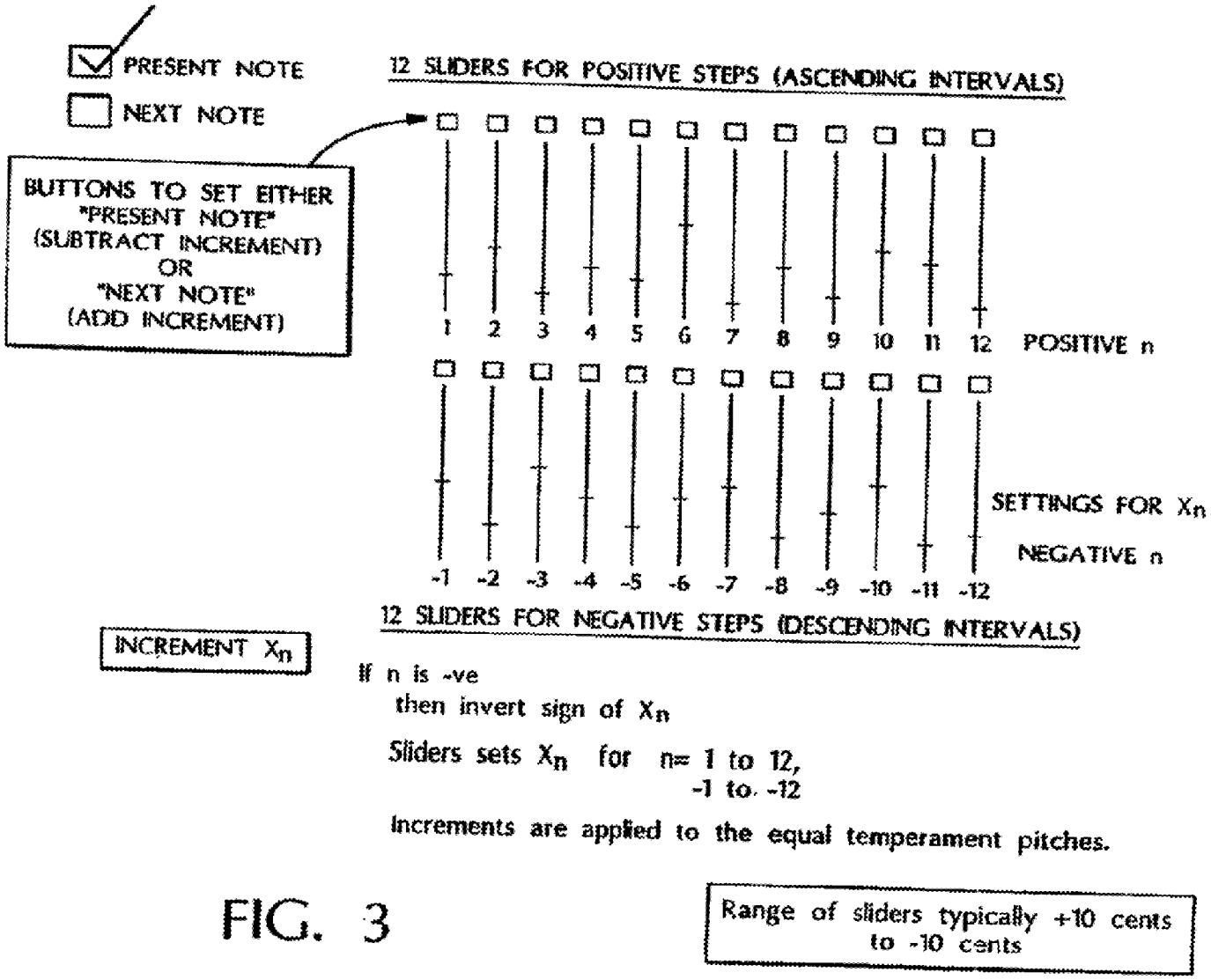

Referring now to FIGS. 1–3, the invention thus considers the twelve intervals of a scale (minor second, major second, minor third, major third, fourth, diminished fifth, fifth, minor sixth, major sixth, minor seventh, major seventh, octave) each as two successive melodic notes. These twelve intervals can be ascending or descending, giving 24 interval possibilities. Furthermore, in each case, a choice is made for changing either the first note or the second note of the interval in pitch. This provides a total of 48 possibilities. (To increase a given interval (compared to that of equal temperament) of two successive notes, e.g., by 2.1 cents, one may lower the first note of the interval by 2.1 cents, or raise the second note of the interval by 2.1 cents.) The first note can be denoted as "the present note" and the second note as "the next note" of that voice as it is played. Since each interval increment may be positive or negative, the categorical number of possibilities is 96.

In its use, each of the 24 interval possibilities can be assigned a distinct increment in pitch (compared to equal temperament), either positive or negative. In practice, certain intervals have greater importance in providing the necessary musicality than others. The most salient are intervals of semitones, +1 and −1.

The ascending semitone is decreased by a small increment, as in the leading tone going to tonic; increasing the pitch the first note of the interval preferably does this. In the descending phase, however, the interval of the semitone is typically increased, e.g., by lowering the pitch of the second note of the interval.

As an initial procedure, the successive intervals (also called "steps") of a particular voice, or melodic line, are calculated as "the step series." This is made simple by the accepted practice, as in MIDI or C sound, of denoting the pitch of notes as integers, or index numbers, rather than as frequencies. Accordingly, the intervals (steps) are whole numbers, equal to the number of semitones in that interval, obtained by subtracting the pitch number of one tone from the next. This provides a series of positive and negative integer numbers giving the successive intervals of that voice, as the step series for that voice (−12 to +12). Steps larger than 12 are reduced to that range by considering them as modulus 12, e.g., a step of 15 is treated as 3.

This step (interval) series is used to attribute particular increments in pitch (positive or negative), typically a few cents, depending on the interval, with a resolution of 0.1 cent, to one of the two notes of the interval.

Adding increments to the pitch of notes having pitches corresponding to equal temperament is made especially simple by the fact that, in computer music systems and in synthesizers, those notes are represented as whole numbers (integers) or indeces. Thus a note of pitch 2 becomes a note of pitch 2.027 if the increment is +2.7 cents. An octave higher, the note of pitch 14 becomes 14.027 (for each octave there are 12 equal temperament semitones, each contributing 1 to the number).

The increments are applied at all octaves in the same manner. (It is to be noted that an increment may itself be negative or positive: in this description, we shall not call a negative increment a "decrement," for simplicity.)

A table of increments is set up, e.g. for use either as default or under user control, which determines the increment that a particular step (interval) receives. The table also contains a decision, included in the default, for use of the first or the second note of a particular step size to modify its size.

It is interesting that, in this kind of tuning, the importance often lies more in the interval size than in which of the two notes are modified, since the modifications are so small, e.g., a shift of the entire interval by just 2 cents is experienced less acutely than a 2 cent change in melodic size. In terms of absolute pitch, 2 cents is a very small change and hardly noticeable, but in terms of relative pitch the change does matter. The short-term memory of the brain with respect to successive pitch in a musical context thus is seen to be extraordinarily sensitive and discriminating, and easily capable of accomplishing such an astonishing feat.

The increment added to the pitch number of the note determines its new pitch, e.g. in the same way as in the well-known pitch bend function, or in providing vibrato to a note.

In computing practice, a flag denotes the expected arrival of the next note. It is also possible to avoid a second increment involving the same note, if this should occur, by letting a flag block the second increment.

In one embodiment, any increment may be slightly sloped over the duration of the note, so that it has a very slight increase and decrease over its course, e.g., a 2.7 positive increment may begin at 2.2 cents, increase to 2.7 cents in the middle of the note and then fall off to 2.3 cents towards the end of the note. Such a time course is a further, optional refinement that, in most instances, is not at all necessary. However, it may be implemented, e.g., using the traditional pitch bend function, as, for example, incorporated in Super-Conductor®, systematized for all notes, if desired. (This is not to be confused with portamento, a much larger slide of frequencies; rather, one may consider this option as a "microportamento.")

As a still further refinement, the expressive intonation pitch changes may be scaled to take into account the duration of the note, or the tempo. The changes can be modified to be somewhat reduced as the duration of the note is longer, or the tempo is slower. According to the experience of some highly distinguished interpreters of music (e.g., Pablo Casals), this change may be desirable for the pitch changes in the semitone steps.

In practice, the main contributors to expressive intonation are modifications of semitone steps (e.g., from B to C, and from E to F in the key of C major), followed by those of whole tone steps, and then major and minor thirds, fourths and fifths. Diminished fifths (or augmented fourths) occur less frequently, as do major sixths and major sevenths, but minor seventh modifications are relatively more often encountered. All can be differentially incremented (ascending and descending). Even octave intervals can benefit from expressive intonation. The ability to provide quantitative and specific increments of pitch for all these intervals provided by computer technology and the methods of this invention make it possible to study and enlarge the scope of expressive intonation beyond what is known today, even by the best musicians, whose knowledge of such incrementing is qualitative and tends to be restricted to a few most commonly attributed intervals.

Chordal harmonies will be slightly and variably affected by expressive intonation. However, as in human performance, expressive melodic intonation mostly has the upper hand, and may actually often improve chordal harmony. Where there are no melodies, and only sustaining chordal tones, expressive intonation can be disabled at will if deemed desirable to do so. In piano or harpsichord pieces, it can sometimes be to good effect to assign expressive intonation to the top voice and the bass, while the inner voices remain in equal temperament. It then becomes somewhat like a singer or violinist who freely plays with expressive intonation together with a piano, harpsichord, or organ having fixed equal temperament tuning. A note played before a rest in the same voice has no influence on the first note after a rest.

For using expressive intonation in improvisations, the method can readily be used by setting all interval increments to the "next note mode," and providing the pitch increment very fast, e.g., in a few milliseconds, to the note being played at the moment (this being the "next note," whereas the previous note played in that voice becomes in effect the "present note." Since the increment will then be placed on the note practically simultaneously with its being played, it functions smoothly and without any noticeable pitch sliding effect. To obtain this effect, the melodic step series has also to be computed as the melody or voice is being played, so when a new note is played, its desired nominal pitch is compared with the nominal pitch of the previous note, stored in computer memory (as explained in previous sections) to calculate the step in semitones between the previously played note and the presently played note. Using this step information, the computer selects the appropriate increment for that interval, and very quickly, almost instantly, increments the nominal pitch of the note that has been struck, before even the key hits bottom.

A number of embodiments of the invention have been described. Nevertheless, it will be understood that various modifications may be made without departing from the spirit and scope of the invention. Accordingly, other embodiments are within the scope of the following claims.

What is claimed is:

1. A method for expressive intonation tuning of electronic, synthesizer and computer music comprising:

considering a first note of a melodic interval, the melodic interval comprising a succession of two notes, considering a second note of the melodic interval, the second note following the first note, and incrementally emending a nominal pitch of the first note of the melodic interval or the second note of the melodic interval depending on a nominal pitch of the second note of the melodic interval relative to that of the first note of the melodic interval.

2. The method of claim 1, further comprising:

considering whether the melodic interval containing the first note and the second note is ascending or descending, and incrementally emending the nominal pitch of the first note or of the second note, depending on whether the melodic interval is ascending or descending.

3. The method of claim 2, further comprising:

assigning to each melodic interval a specifically-sized increment of predetermined value, to increase or decrease that melodic interval.

4. The method of claim 3, further comprising assigning a specifically sized increment of predetermined value in a range of between about +10 cents and −10 cents, with resolution of 0.1 cent, to the melodic interval.

5. The method of claim 1, further comprising increasing or decreasing a pitch of a note in the melodic interval relative to an equal temperament system by up to 24 specific characteristic increments, each of said characteristic increments being assigned to one of 12 ascending and 12 descending intervals of a scale.

6. The method of claim 1, further comprising assigning specific increments to notes of the melodic interval according to a step series denoting a sequence of melodic steps occurring in a particular voice of a musical work.

7. The method of claim 5, further comprising presenting each melodic step as a number of semitones.

8. The method of claim 5, further comprising assigning to each voice of a musical work a step series and pitch increments.

9. The method of claim 1, further comprising combining each step with an index denoting subtract increment from the present note or add increment to the next note to provide 48 different assignment actions.

10. The method of claim 9, further comprising generating music incorporating the incremented pitch values.

11. The method of claim 9, further comprising scaling the increment according to duration of specific notes, with relatively faster notes receiving relatively larger increments.

12. The method of claim 10, further comprising applying the pitch increment gradually over a duration of a note, rising to a peak value and then falling towards an end of the note.

13. The method of claim 1, further comprising applying the increments of pitch following an adjustable curve.

14. The method of claim 9, further comprising selectively disabling expressive intonation tuning of one or more voices of the musical work.

15. The method of claim 1, further comprising providing preset default values for pitch increment values and index settings.

16. The method of claim 15, further comprising modifying default values for requirements of a specific musical work or of one or more parts of a musical work.

17. The method of claim 15, further comprising modifying default values for requirements of ethnic music, jazz, blues, reggae, or other popular music.

18. The method of claim 10, for improvisations, comprising:

as the second note is played, comparing its nominal pitch with the nominal pitch of the first note stored in computer memory;

calculating the step in semitones between the first note and the second note; and selecting an appropriate increment and applying it immediately to the nominal pitch of the second note.

19. The method of claim 18, further comprising applying an appropriate increment to a nominal pitch of the second note within a few milliseconds of playing of the second note.

20. The method of claim 18, further comprising applying an appropriate increment to a nominal pitch of the second note before a key hits bottom.

* * * * *

UNITED STATES PATENT AND TRADEMARK OFFICE

CERTIFICATE OF CORRECTION

PATENT NO. : 6,924,426 B2
DATED : August 2, 2005
INVENTOR(S) : Dr. Manfred Clynes It is certified that error appears in the above-identified patent and that said Letters Patent is hereby corrected as shown below:

The title page showing the illustrative figure should be deleted to be replaced with the attached title page.

Drawings sheets, consisting of Figs. 1-3, should be deleted to be replaced with the drawing sheets, consisting of Figs. 1-3, as shown on the attached page.

Title page,
Under Item [57], "3 Drawing Sheets" should read -- 2 Drawings Sheets --.

Signed and Sealed this

Fourth Day of October, 2005

JON W. DUDAS
*Director of the United States Patent and Trademark Office*

(12) United States Patent
Clynes

(10) Patent No.: US 6,924,426 B2
(45) Date of Patent: Aug. 2, 2005

(54) AUTOMATIC EXPRESSIVE INTONATION TUNING SYSTEM

(75) Inventor: Manfred Clynes, Sonoma, CA (US)

(73) Assignee: Microsound International Ltd., Sonoma, CA (US)

( * ) Notice: Subject to any disclaimer, the term of this patent is extended or adjusted under 35 U.S.C. 154(b) by 259 days.

(21) Appl. No.: 10/259,863

(22) Filed: Sep. 30, 2002

(65) Prior Publication Data

US 2004/0060423 A1 Apr. 1, 2004

(51) Int. Cl.[7] ..... G04B 13/00; G10H 7/00

(52) U.S. Cl. ..... 84/609; 84/611; 84/649; 84/651; 84/454; 84/DIG. 18

(58) Field of Search ..... 84/600, 609–611, 84/649–651, 454–455, DIG. 18

(56) References Cited

U.S. PATENT DOCUMENTS 4,152,964 A * 5/1979 Waage ..... 84/675
4,248,119 A * 2/1981 Yamada ..... 84/637
4,523,506 A * 6/1985 Hollimon ..... 84/454
5,501,130 A 3/1996 Gannon et al.
5,973,252 A * 10/1999 Hildebrand ..... 84/603
6,093,879 A * 7/2000 Pye ..... 84/451
6,407,326 B1 6/2002 Kondo ..... 84/615
6,501,011 B2 * 12/2002 Wesley ..... 84/719

* cited by examiner

*Primary Examiner*—Marlon Fletcher
(74) *Attorney, Agent, or Firm*—Fish & Richardson P.C.

(57) ABSTRACT

A method for the algorithmic expressive intonation tuning (EIT) and performance of electronic, computer and MIDI musical works relies on melodic intervals, rather than on chordal harmony, and acts by desirably modifying the pitch of a note slightly (compared to equal temperament tuning), depending on the next melodic note. This dynamic, non static, melodic tuning emulates, and can even possibly augment, aspects of outstanding live human musical performance achieved with regard to pitch subtleties, as it enhances the living sounding, real aspects of the performance of electronic, computer and MIDI music, by sensibly causing a slightly different pitch of particular notes, depending on the size of an interval and on whether an interval is ascending or descending, with the same note subtly having more than one pitch often, depending on melodic context. This method of tuning affecting the notes has a further advantage of not requiring transposition, regardless of how much the music modulates, since it uses melodic intervals. It can treat entire symphonies of more than 100 voices simultaneously as easily as solo works.

20 Claims, 3 Drawing Sheets

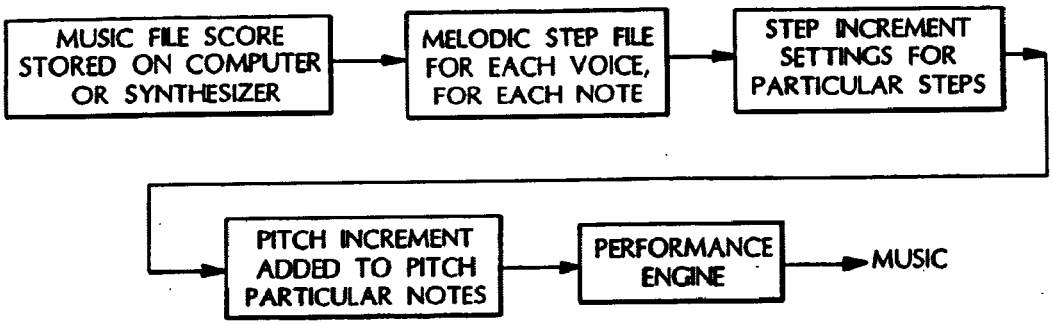

STEP MEANS THE SAME AS "INTERVAL"

STEP MEANS THE SAME AS "INTERVAL"

STEP = NUMBER OF SEMITONES TO THE NEXT NOTE.

UNITED STATES PATENT AND TRADEMARK OFFICE

CERTIFICATE OF CORRECTION

PATENT NO. : 6,924,426 B2
APPLICATION NO. : 10/259863
DATED : August 2, 2005
INVENTOR(S) : Dr. Manfred Clynes It is certified that error appears in the above-identified patent and that said Letters Patent is hereby corrected as shown below:

The title page showing the illustrative figure should be deleted to be replaced with the attached title page.

Drawings sheets, consisting of Figs. 1-3, should be deleted to be replaced with the drawing sheets, consisting of Figs. 1-3, as shown on the attached page.

This certificate supersedes Certificate of Correction issued October 4, 2005.

Signed and Sealed this

Sixth Day of February, 2007

JON W. DUDAS
*Director of the United States Patent and Trademark Office*

(12) United States Patent
Clynes

(10) Patent No.: US 6,924,426 B2
(45) Date of Patent: Aug. 2, 2005

(54) AUTOMATIC EXPRESSIVE INTONATION TUNING SYSTEM

(75) Inventor: Manfred Clynes, Sonoma, CA (US)

(73) Assignee: Microsound International Ltd., Sonoma, CA (US)

( * ) Notice: Subject to any disclaimer, the term of this patent is extended or adjusted under 35 U.S.C. 154(b) by 259 days.

(21) Appl. No.: 10/259,863

(22) Filed: Sep. 30, 2002

(65) Prior Publication Data

US 2004/0060423 A1 Apr. 1, 2004

(51) Int. Cl.[7] ..... G04B 13/00; G10H 7/00

(52) U.S. Cl. ..... 84/609; 84/611; 84/649; 84/651; 84/454; 84/DIG. 18

(58) Field of Search ..... 84/600, 609–611, 84/649–651, 454–455, DIG. 18

(56) References Cited

U.S. PATENT DOCUMENTS 4,152,964 A * 5/1979 Waage ..... 84/675
4,248,119 A * 2/1981 Yamada ..... 84/637
4,523,506 A * 6/1985 Hollimon ..... 84/454
5,501,130 A 3/1996 Gannon et al.
5,973,252 A * 10/1999 Hildebrand ..... 84/603
6,093,879 A * 7/2000 Pye ..... 84/451
6,407,326 B1 6/2002 Kondo ..... 84/615
6,501,011 B2 * 12/2002 Wesley ..... 84/719

* cited by examiner

*Primary Examiner*—Marlon Fletcher
(74) *Attorney, Agent, or Firm*—Fish & Richardson P.C.

(57) ABSTRACT

A method for the algorithmic expressive intonation tuning (EIT) and performance of electronic, computer and MIDI musical works relies on melodic intervals, rather than on chordal harmony, and acts by desirably modifying the pitch of a note slightly (compared to equal temperament tuning), depending on the next melodic note. This dynamic, non static, melodic tuning emulates, and can even possibly augment, aspects of outstanding live human musical performance achieved with regard to pitch subtleties, as it enhances the living sounding, real aspects of the performance of electronic, computer and MIDI music, by sensibly causing a slightly different pitch of particular notes, depending on the size of an interval and on whether an interval is ascending or descending, with the same note subtly having more than one pitch often, depending on melodic context. This method of tuning affecting the notes has a further advantage of not requiring transposition, regardless of how much the music modulates, since it uses melodic intervals. It can treat entire symphonies of more than 100 voices simultaneously as easily as solo works.

20 Claims, 3 Drawing Sheets

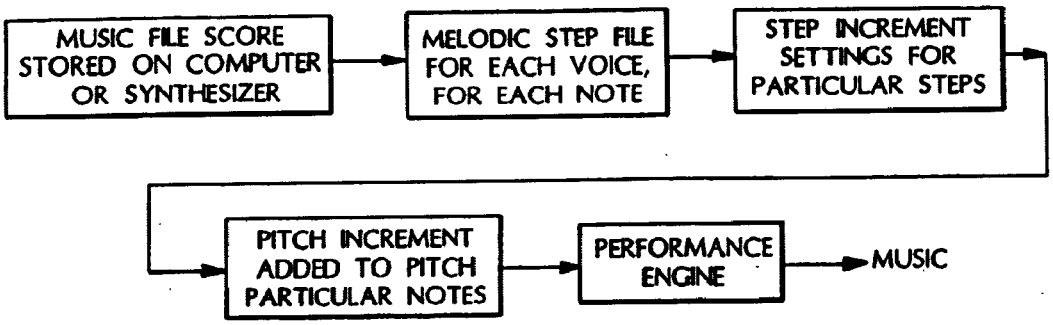

STEP MEANS THE SAME AS "INTERVAL"

STEP MEANS THE SAME AS "INTERVAL"

UNITED STATES PATENT AND TRADEMARK OFFICE

CERTIFICATE OF CORRECTION

PATENT NO. : 6,924,426 B2
APPLICATION NO. : 10/259863
DATED : August 2, 2005
INVENTOR(S) : Dr. Manfred Clynes It is certified that error appears in the above-identified patent and that said Letters Patent is hereby corrected as shown below:

The title page showing the illustrative figure should be deleted to be replaced with the attached title page.

Drawings sheets, consisting of Figs. 1-3, should be deleted to be replaced with the drawing sheets, consisting of Figs. 1-3, as shown on the attached page.

This certificate supersedes Certificate of Correction issued October 4, 2005 and February 6, 2007.

Signed and Sealed this

Eighth Day of May, 2007

JON W. DUDAS
*Director of the United States Patent and Trademark Office*

(12) United States Patent
Clynes

(10) Patent No.: US 6,924,426 B2
(45) Date of Patent: Aug. 2, 2005

(54) AUTOMATIC EXPRESSIVE INTONATION TUNING SYSTEM

(75) Inventor: Manfred Clynes, Sonoma, CA (US)

(73) Assignee: Microsound International Ltd., Sonoma, CA (US)

( * ) Notice: Subject to any disclaimer, the term of this patent is extended or adjusted under 35 U.S.C. 154(b) by 259 days.

(21) Appl. No.: 10/259,863

(22) Filed: Sep. 30, 2002

(65) Prior Publication Data

US 2004/0060423 A1 Apr. 1, 2004

(51) Int. Cl.[7] ..... G04B 13/00; G10H 7/00

(52) U.S. Cl. ..... 84/609; 84/611; 84/649; 84/651; 84/454; 84/DIG. 18

(58) Field of Search ..... 84/600, 609–611, 84/649–651, 454–455, DIG. 18

(56) References Cited

U.S. PATENT DOCUMENTS 4,152,964 A * 5/1979 Waage ..... 84/675
4,248,119 A * 2/1981 Yamada ..... 84/637
4,523,506 A * 6/1985 Hollimon ..... 84/454
5,501,130 A 3/1996 Gannon et al.
5,973,252 A * 10/1999 Hildebrand ..... 84/603
6,093,879 A * 7/2000 Pye ..... 84/451
6,407,326 B1 6/2002 Kondo ..... 84/615
6,501,011 B2 * 12/2002 Wesley ..... 84/719

* cited by examiner

*Primary Examiner*—Marlon Fletcher
(74) *Attorney, Agent, or Firm*—Fish & Richardson P.C.

(57) ABSTRACT

A method for the algorithmic expressive intonation tuning (EIT) and performance of electronic, computer and MIDI musical works relies on melodic intervals, rather than on chordal harmony, and acts by desirably modifying the pitch of a note slightly (compared to equal temperament tuning), depending on the next melodic note. This dynamic, non static, melodic tuning emulates, and can even possibly augment, aspects of outstanding live human musical performance achieved with regard to pitch subtleties, as it enhances the living sounding, real aspects of the performance of electronic, computer and MIDI music, by sensibly causing a slightly different pitch of particular notes, depending on the size of an interval and on whether an interval is ascending or descending, with the same note subtly having more than one pitch often, depending on melodic context. This method of tuning affecting the notes has a further advantage of not requiring transposition, regardless of how much the music modulates, since it uses melodic intervals. It can treat entire symphonies of more than 100 voices simultaneously as easily as solo works.

20 Claims, 3 Drawing Sheets

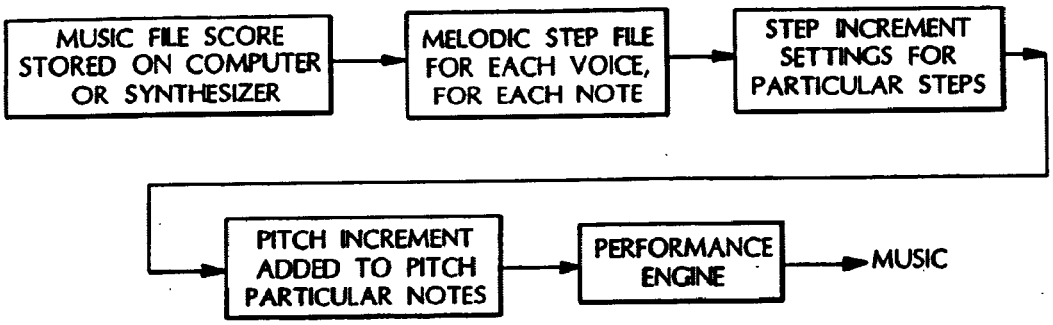

STEP MEANS THE SAME AS "INTERVAL"

STEP MEANS THE SAME AS "INTERVAL"